US006485777B1

(12) United States Patent
Riedener et al.

(10) Patent No.: US 6,485,777 B1
(45) Date of Patent: Nov. 26, 2002

(54) METHOD AND DEVICE FOR COATING SHEETS

(75) Inventors: Philipp Riedener, Untereggen (CH); Ernst Sturzenegger, Gossau (CH)

(73) Assignee: Steinemann Technology AG, St. Gallen (CH)

( * ) Notice: Subject to any disclaimer, the term of this patent is extended or adjusted under 35 U.S.C. 154(b) by 0 days.

(21) Appl. No.: 09/646,795

(22) PCT Filed: Mar. 23, 1999

(86) PCT No.: PCT/CH99/00124

§ 371 (c)(1),
(2), (4) Date: Nov. 24, 2000

(87) PCT Pub. No.: WO99/48690

PCT Pub. Date: Sep. 30, 1999

(30) Foreign Application Priority Data

Mar. 24, 1998 (CH) ..... 0688/98

(51) Int. Cl.[7] ..... B05D 3/14

(52) U.S. Cl. ..... 427/8; 118/244; 118/500; 427/256; 427/385.5; 427/430.1

(58) Field of Search ..... 427/8, 256, 385.5, 427/430.1; 118/244, 500

(56) References Cited

U.S. PATENT DOCUMENTS

| | | | | |
|---|---|---|---|---|
| 2,363,137 A | 11/1944 | Metcalf | ..... | 101/120 |
| 5,518,569 A | 5/1996 | Achilles et al. | ..... | 156/250 |

FOREIGN PATENT DOCUMENTS

| | | | | |
|---|---|---|---|---|
| DE | 693 00 644 | 11/1996 | ..... | B41F/15/16 |
| DE | 196 26 821 | 1/1998 | ..... | B41F/15/08 |
| DE | 197 03 312 | 8/1998 | ..... | B41M/1/12 |
| DE | 198 12 894 | 10/1998 | ..... | B41M/1/12 |
| NL | 9201679 | 4/1994 | ..... | B41F/15/10 |

*Primary Examiner*—Bernard Pianalto
(74) *Attorney, Agent, or Firm*—Finnegan, Henderson, Farabow, Garrett & Dunner, L.L.P.

(57) ABSTRACT

A device for coating a sheet comprises at least one screen cylinder configured to be positioned downstream of a sheet feeding mechanism. The screen cylinder is further configured to coat a sheet. The device further comprises a constant conveyor for feeding a sheet from the feeding mechanism to the screen cylinder and a variable speed drive for rotating the screen cylinder. The variable speed drive is configured to rotate the screen cylinder based on one of a print length and a print position of the sheet to be coated.

38 Claims, 7 Drawing Sheets

METHOD AND DEVICE FOR COATING SHEETS

TECHNICAL SCOPE

Figure 1:
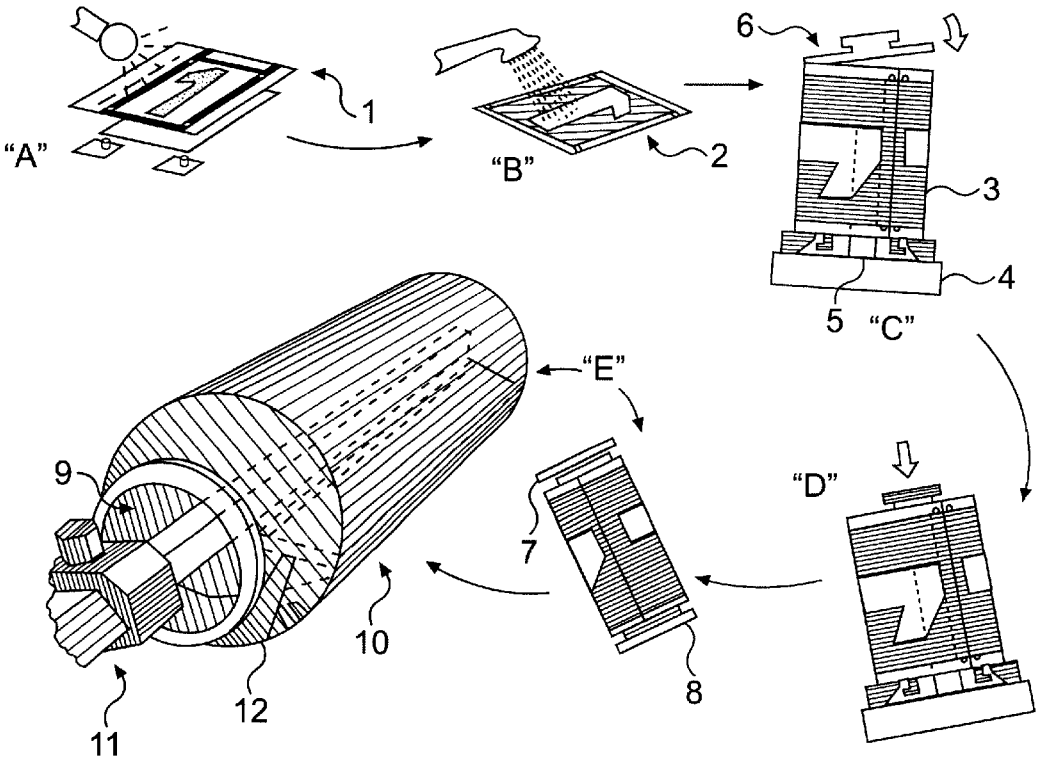

The invention relates to a method and its use for coating sheets or sections by means of screen cylinders whose rotation is coordinated, where the sheets or sections are removed from a stack and sent by forced feed to the coating station. This invention also relates to a device for continuous precision coating of sheets or sections by means of screen cylinders and counter-pressure cylinders with a feed station and a horizontal feed device.

STATE OF THE ART

An enormous variety of coating sheets and sections are known today. On the one hand, there is the traditional offset and gravure printing, where photographic-quality results can be achieved. On the other hand, there is simple lacquering, with a large number of coating methods in between, for effect printings and special printings, e.g., with body inks, textured inks or fluorescent inks. Each consumer can select from packaging printers, gift paper manufacturers or the manufacturers of project folders and ring binders. Within the various coating and printing methods, screen printing or serigraphy, which has been known since early times, is still being used widely. Rotary web printing is often used today. The printing output with rotary web printing is much higher than that with web screen printing. The main disadvantage of rotary web printing is that only continuous paper can be processed from roll to roll at high throughput speeds. In addition, the processing width with respect to the paper is limited, usually being 20 to 60 cm. In gravure printing, both continuous webs and sheets or sections can be printed. The same thing is true of lacquering. The enormous variety of different processing techniques has the advantage that an optimum technique is available for each coating job. However, there is a great price increase with the individual techniques according to whether a small printing or a large printing is produced. This can lead to the situation where it costs only a fraction as much to produce a large printing of an advertising brochure as it does to print various reprints of portions of the large printing. For example, with a sales network of 30 sales personnel, it is often not economically feasible to generate a corresponding number of special address printings. Despite the very high level of technical advance throughout this industry, one encounters in many cases the paradoxical situation where mass printings are amazingly inexpensive, but each individually adapted small series is prohibitively expensive and even different processing companies must often be involved. The present inventors have recognized the fact that not only are screen printing, lacquering and coating with special materials such as adhesives similar techniques, but also there is a demand for a single processing department or company to be able to use these different techniques. Screen printing has the great advantage that relatively low forces are needed between the screen cylinder and the sheets. The main problem in rotary screen printing is that the movement between the screen cylinder and a printing cylinder opposite it must be synchronized with high precision during printing, so that the application to the sheets or sections can be made accurately. However, the beginning and end of the sheets to be printed must also exactly match the print original as obtained from the motion of the screen cylinder. The screen printing intended here is a finishing operation, often performed on a preprinted sheet. This may involve, for example, relief lacquering, where only narrowly defined areas within a sheet must be coated with a lacquer layer with a high precision. In the known state of the art, the sheets are held by grippers arranged with a space between them and secured to chains. The grippers are guided accurately during the printing operation. The counter-pressure rolls have recesses on the circumference for this purpose to allow the grippers to pass through. One of the main problems is satisfactory positioning of the objects relative to the printing roll and securing it during printing. Inaccurate placement or even deformation of the printed image must be avoided.

German Patent No. 693,644 is based on the object of developing a device that permits accurate positioning with regard to time and place along at least part of the path on which the objects are printed. It is proposed here that a short guide device be arranged with the highest precision within a continuous mechanical conveyor so that individual sheets can be moved in absolute synchronization with the printing cylinder. Unexamined German Patent No. 197 03 312 also concerns screen printing cylinder machines with a printing cylinder that is driven by a drive motor and receives the print material. The machine has a rotary screen cylinder which is axially arranged in parallel at a distance and is driven independently by a drive motor; it also concerns a device for synchronizing the motion of the printing cylinder and the screen cylinder during the printing operation. It has been found that the older printing method has some disadvantages with regard to acceleration of the printing cylinder, because this acceleration can cause the entire machine to vibrate. To solve this problem, it has been proposed that the printing cylinder, which has a circumference greater than or equal to the circumference of the screen cylinder, rotates at an essentially constant speed. The aforementioned patent cites as a great advantage the fact that the control expense for synchronization of the screen movement and the printing cylinder can be minimized due to the essentially constant rotational speed.

Both options have in common the fact that there are certain disadvantages, in particular with regard to mechanical controllability. Studies so far have shown that the state of the art has reached a very high quality standard with regard to flatbed printing. For example, distortion of sheets due to the effects of heat or moisture is often compensated in practice by corresponding distortion of the flatbed original or by replacing it with another flatbed original. This technique is difficult to apply to screen cylinders and would lead to complicated solutions. The present inventor has recognized that a concept must be developed to allow individual utilization of machines or a design for screen cylinders in particular, so that even smaller series can be coated inexpensively and economically in a high quality, and that one or more different operations of this type may optionally be carried out with one machine. The object of this invention was to improve upon the coating of sheets and sections so that they can be produced more rapidly and at a lower price. Another object was to increase the output from 7000 sheets or sections per minute as in the past to 10,000 per minute. According to the teaching of Dutch patent 9,201,676, the substrate such as paper or a textile which is to be printed is conveyed at a predetermined speed through the printing machine. The predetermined conveyance speed necessitates an adjustment of the rotational speed of the screen cylinder. This Dutch is based on material in the form of sheeting, such as paper or fabric which is normally wound onto rolls. However, the problems encountered with paper or fabric sheeting are completely different from those encountered with individual sheets and sections. The important task from the standpoint of the control technology is to make the rotational speed of the screen cylinder essentially the same as the conveyance speed.

EXPLANATION OF THE INVENTION

The object of the present invention was to improve on the coating of sheets and sections such that the standard quality of flatbed printing can also be achieved with rotary screen printing with the highest possible output, so that sheets and sections can be coated inexpensively and economically in small printing runs in particular, and several and/or different techniques can be employed in one installation.

The method according to this invention is characterized in that the rotation of the screen cylinder can be adjusted and/or controlled with respect to the forced feed of sheets or sections, and in particular it can be corrected for a precisely coordinated run during the printing process and for synchronization between the sheets passing through and accurate coating and positioning of the coating on the sheets.

The device according to the present invention is characterized in that it has a precision work station with a constant conveyor for synchronization between the sheets passing through and accurate coating and positioning of the coating on the sheet, and the screen cylinder has a variable speed drive for referencing the screen cylinder with respect to print length and/or print position of the sheets or sections.

The present invention also relates to the use of this method or device and is characterized in that the machine is designed for screen printing as ink printing or lacquering sheets or sections or for applying special coatings such as adhesives or, with an appropriate design of the screen cylinder as a fast-change cylinder, e.g., as a screen printing cylinder, screen lacquering cylinder or as a special screen coating cylinder, where one or more screen cylinders can be used in one or more precision work stations.

The present invention has taken the previously rejected road in comparison with the known related art, namely the road of using an improved control technology. In many cases, an increased output or an improvement in quality can be achieved with great success by simply improving the purely mechanical aspects. However, there tend to be strict limits in this regard. A greater advance is made according to the present invention through better control of the motion of the screen cylinder. Surprisingly, several groups of problems can be solved in a new way by this discovery. The main goal is no longer absolute synchronization of the motion of the printing cylinder and the screen cylinder but instead it is to achieve the greatest possible synchronization between the sheets passing through and accurate coating or placement of the coating on the sheet. The present invention directly relates to the quality of the end product. As shown below, three problem areas can be approached successfully. It is known from experience that the length dimensions of sheets and sections can change due to the effects of moisture or heat. This can even occur while processing a stack. Frequently work is being done on a first stack while subsequent stacks are being stored outside the hot production room, e.g., at a higher or lower temperature or at a different atmospheric humidity. In the extreme case, the difference in length may amount to 0.5 to 1 millimeter. For accuracy in printing, however, a tolerance on the order of plus or minus one tenth of a millimeter is required. The sole requirement of synchronization of the revolution of the screen cylinder and the counter-pressure cylinder does not solve the problems described above. A frequent source of problems is working with several partial lots for the same job or having to divide the lots. Even if there are no differences in weight within a lot, such differences can occur with respect to the sheets or sections of different lots which are processed at longer intervals of time, especially due to the influencing factors mentioned above.

The present invention leads to a very new process technology. Transfer of the sheets from the stack to the forced feed for coating is handled as well as possible with mechanical means. As was also the case previously, the greatest possible accuracy is achieved through a gripper concept. The sheets are conveyed through the coating section by grippers. The disadvantage of the gripper concept is that it requires a considerable expenditure with regard to manufacturing costs. Although a conveyor belt concept would be much simpler, it would also be less accurate due to physical considerations. The accuracy in coating required above can now be achieved with the new concept through a setting or control and correction of the rotation of the screen cylinder. In a very few applications, grippers can be omitted, because accurate positioning of the sheets for coating is achieved by the screen cylinder with the control technology.

In the specific embodiment, control of rotation of the screen cylinder is based on a reference axis and is handled by a control unit which allows operation with or without correction of position. Position errors in individual forced-feed sheets or sections can be corrected by adjusting the starting printing position by controlling the rotation of the screen cylinder. For the duration of the printing operation, the peripheral speed of the screen drum is controlled with respect to the longitudinal repeat of the sheets, using acceleration and/or deceleration of the peripheral speed of the screen for referencing. The screen cylinder is preferably driven by a variable speed servo motor and controlled by a computer, where the position of the respective sheet or section fed to it relative to the motion of the screen cylinder is monitored by sensors at a distance before contact with the screen cylinder. It has also been found that the entire handling of the sheets or sections is optimum if the sheets or sections are conveyed toward and away from the coating station in a horizontal plane and if the sheets or sections are accelerated to the precise processing speed in their transfer from a feed point to the coordinated run during the printing operation.

The screen printing cylinder preferably has a variable speed servo drive, and the counter-pressure cylinder and the sheet transport through the printing machine have a variable speed drive, in particular a variable speed vector drive, which is paired directly with a local control unit or with one control unit for each drive. The entire system is controlled to a very great extent if the required settings or corrections according to the present invention are coordinated locally in the literal sense, i.e., among the elements involved. Therefore, it is proposed that in addition to machine control, a local control module with the individual control units is provided, where the setpoints are preselected by the machine control and the control corrections are made directly by the local control module.

BRIEF DESCRIPTION OF THE INVENTION

Figure 2:
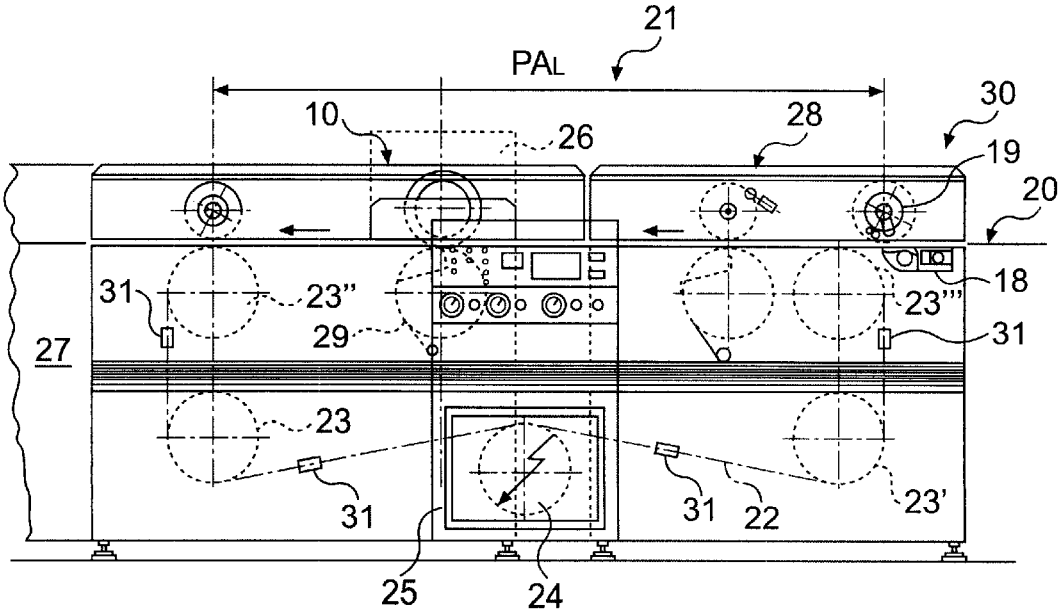
Figure 3:
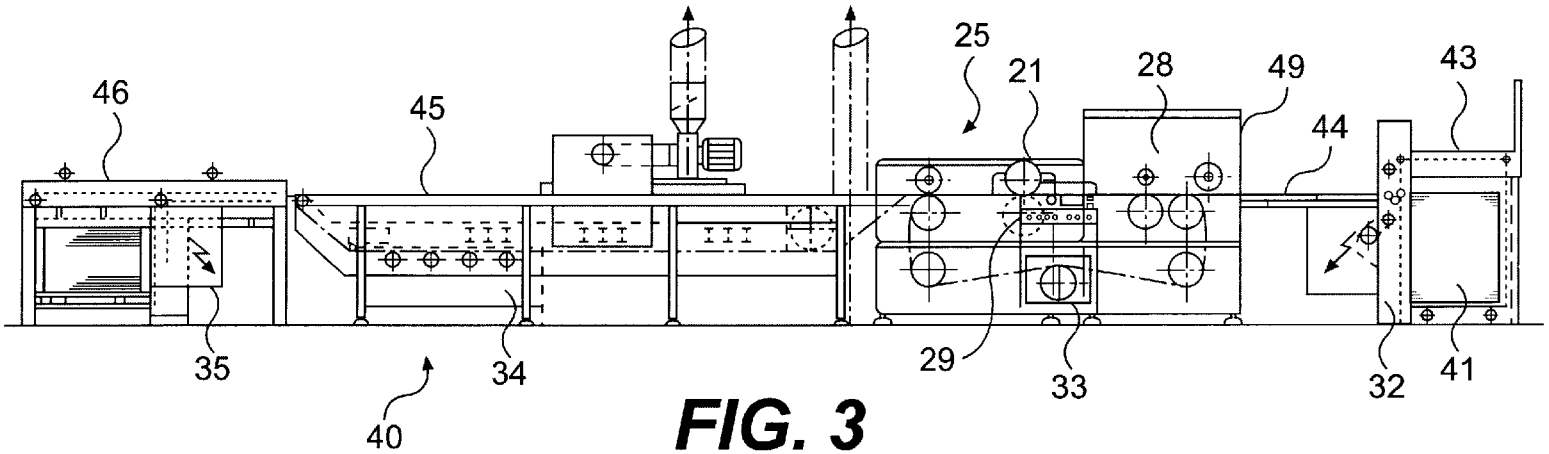
Figure 4:
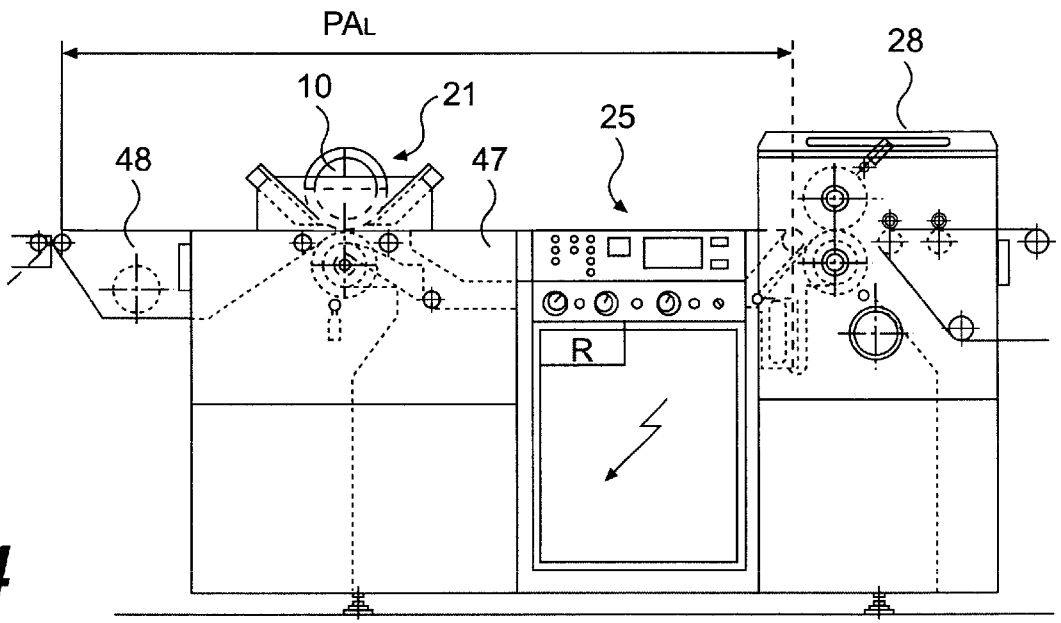
Figure 5:
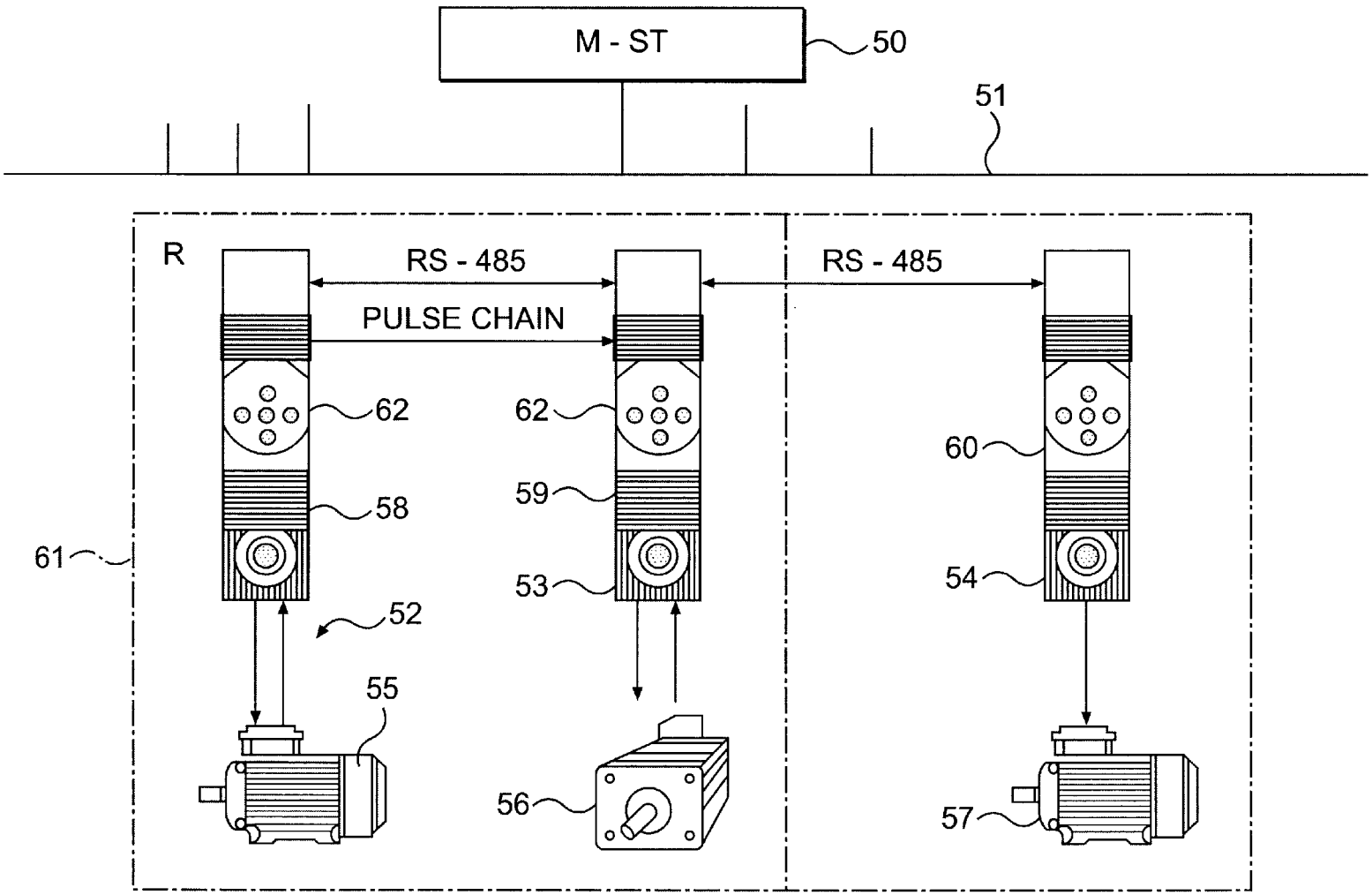
Figure 6:
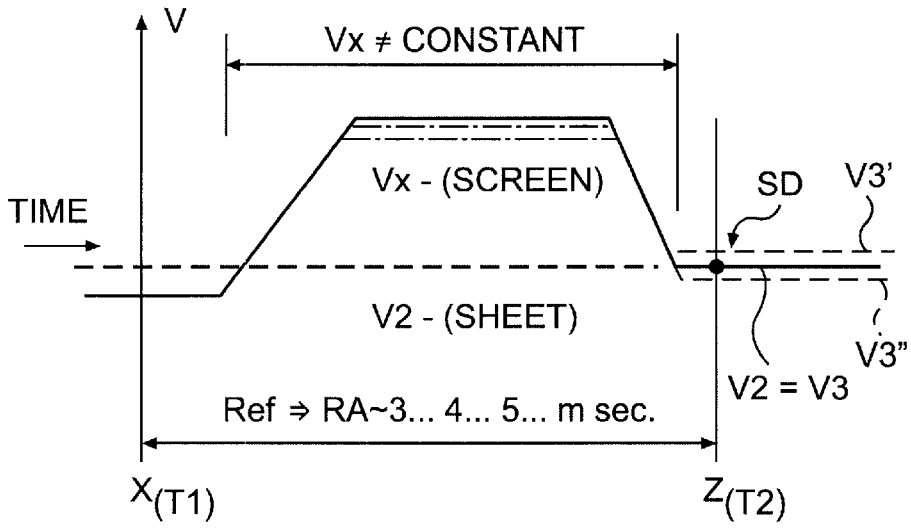
Figure 7:
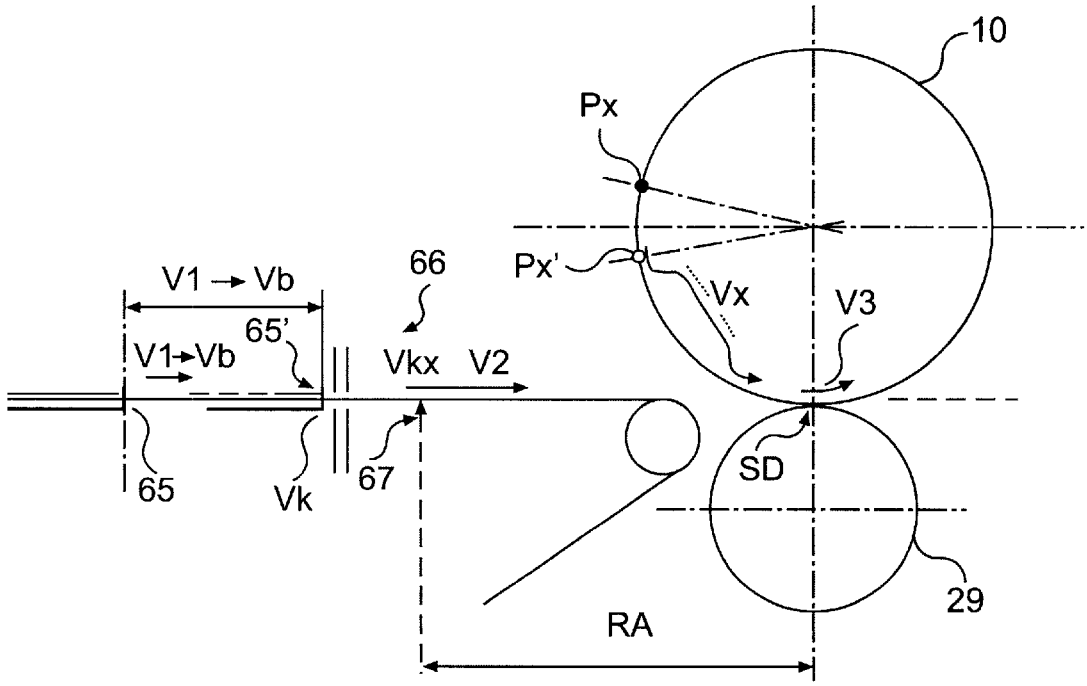
Figure 8:
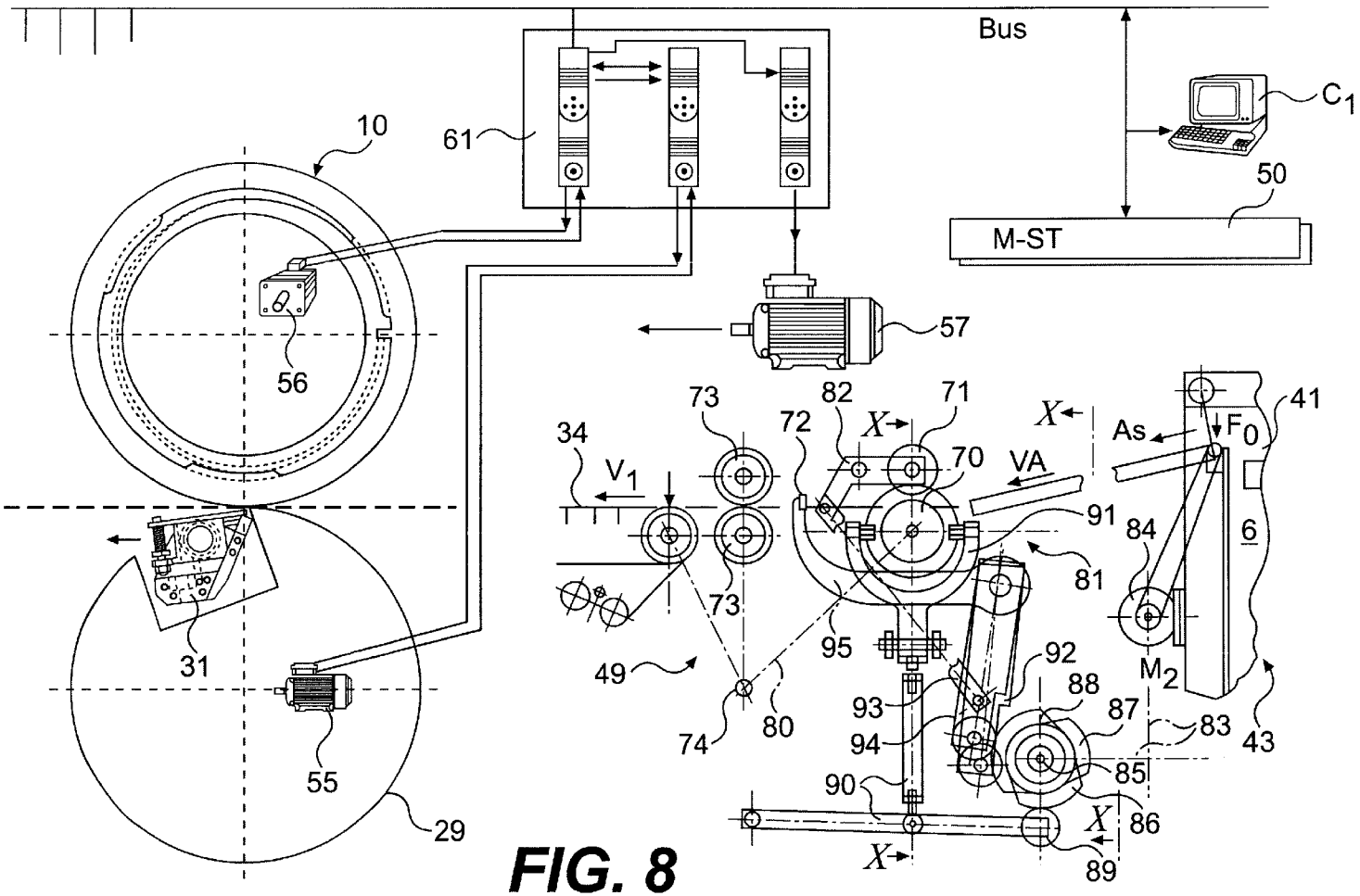
Figure 9:
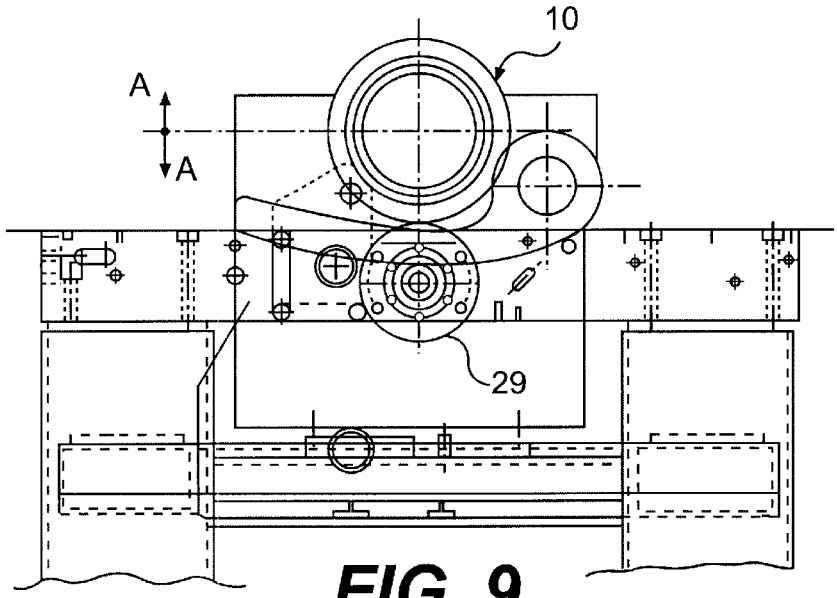
Figure 10:
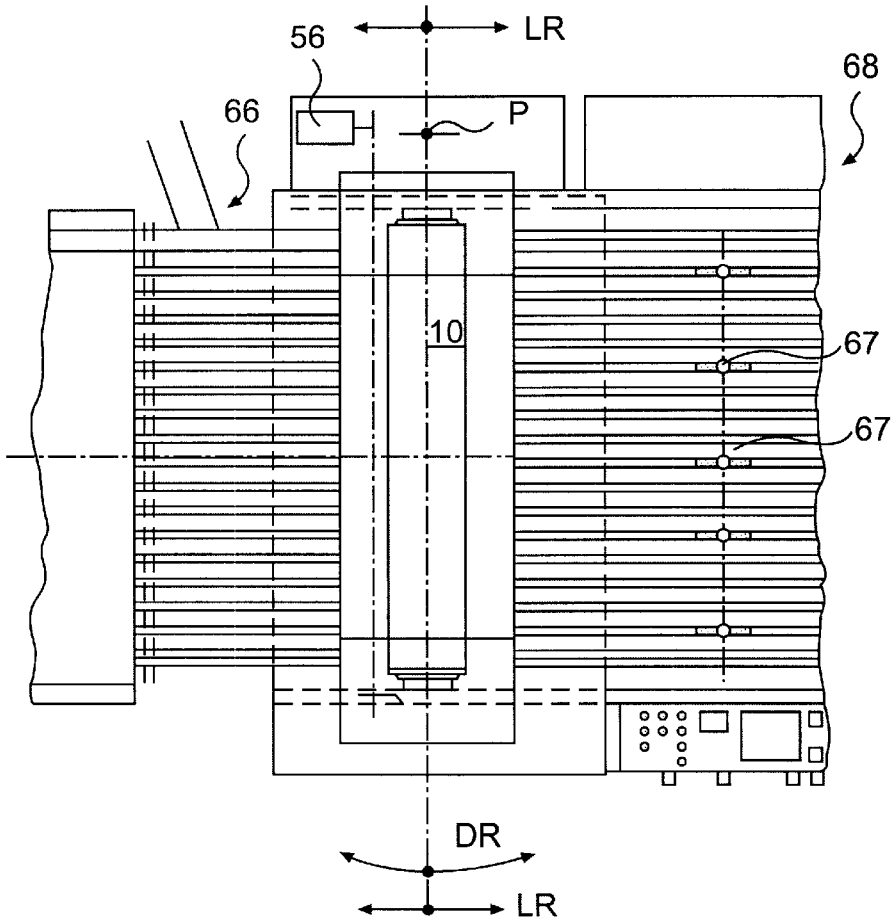
Figure 11:
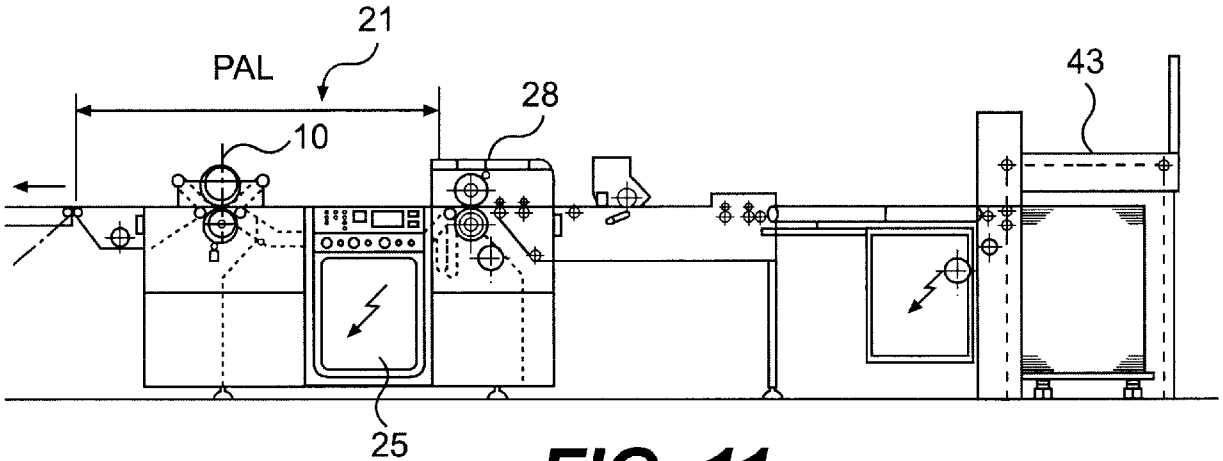
Figure 12:
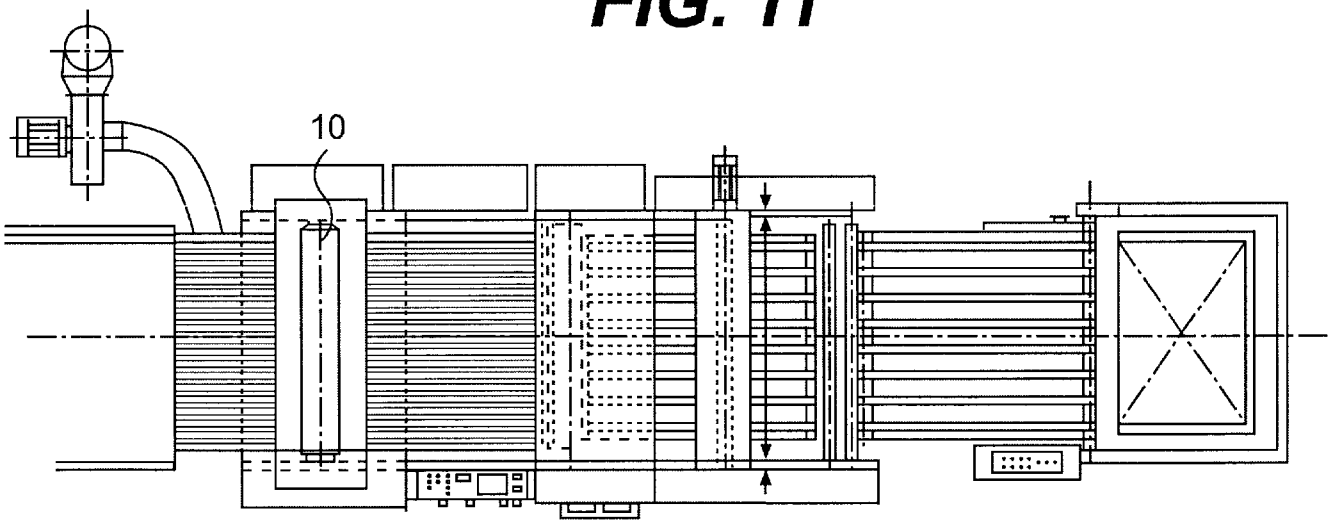

The present invention will now be explained in greater detail on the bases of some embodiments; they show:

FIG. 1: a diagram of production of the screen cylinder printing form for rotary screen printing according to the state of the art;

FIG. 2: a precision work station with a screen cylinder for processing in a plane;

FIG. 3: an entire installation for coating sheets;

FIG. 4: the precision work station on a larger scale with an inlet and outlet table and a calendar;

FIG. 5: a preferred control scheme with a local control module;

FIGS. 6 and 7: diagrams of the control of the screen drum with a control ramp;

FIG. 8: the gripper set in a position close to the screen cylinder and the transfer from a feed station to the precision work station with acceleration of the sheet;

FIGS. 9 and 10: front view and a horizontal projection of the precision work station;

FIGS. 11 and 12: front view and horizontal projection of an installation from a feed station to a precision work station.

METHODS AND EMBODIMENTS OF THE INVENTION

FIG. 1 shows in diagram form the processing of a print original "A" up to a ready-to-use screen printing cylinder 10 ("E"). This process is shown with six illustrations "A" through "E" in this Figure. Print original 1 is exposed after a prior film production step. At "B" the desired screen orifices are washed out to yield a flat printing form 2. Then the flat printing form 2 is mounted on a cylinder and placed on a prepared form carrier 4 as a cylindrical printing form 3. Form carrier 4 indicates not only the cylindrical form but also has a central axis 5, so that the position of the axis of rotation can be determined accurately. A stencil ring 6 is placed from above into the cylindrical printing form 3 and is mounted on axle 5 ("C"). The printing form is then glued to the carrier element ("D"), and the screen cylinder which is now completed, is equipped with the required overdrive elements 7, 8 ("E") and it can be inserted into the machine. The entire process takes about half an hour. Since the screen cylinder has a large opening 9 on one side, the material feed 11 for the coating medium as well as a doctor blade 12 can be introduced into the screen cylinder through the opening 9. This design makes it possible to change the screen cylinder 10 very rapidly, from a first printing form to a second screen cylinder with a second printing form, etc. Production of a rotary screen printing cylinder is state of the art for printing continuous sheeting.

In FIG. 2, the sheets or sections are processed on a horizontal plane which also forms a working table plane 20 from the feed station to the discharge station. The sheets are fed over an aligning station 18 and a vibrating installation 19 and sent to calendering. A precision work station 21 has a chain belt or a toothed belt 22 which is guided over the entire precision work zone PAL by means of guide rollers 23, 23', 23", 23'" under tension. Conveyance by chain belt or toothed belt 22 is driven by a motor 24 which can be controlled by a machine control 25. Furthermore, it is also possible to provide additional process steps, e.g., smooth calendering 28 or brushing within the precision work zone PAL. A counter-pressure roll 29 is arranged at the precision work station, directly opposite screen cylinder 10. The number 27 indicates only that one or more additional stations or more of the same station may be provided upstream or downstream a precision work station 21. Mechanical forced feed in the entire work area PAL is important for the precision work station. This is ensured by a mechanical gripper station 30 at the beginning and by a sheet separation station for the mechanical grippers in addition to the chain belt or toothed belt. In FIG. 2, forced sheet feed is accomplished by chains and grippers 31.

FIG. 3 shows an entire installation 40 for handling sheets or sections 41. At the right in the figure there is a feed station 43 followed by a belt transport 44 and the precision work station 21. A station 45 for drying, curing and stabilization of the processed sheets is connected downstream from the precision work station, followed by a discharge station 46. FIG. 3 shows a control box 32 for the feed station, a main control box 33, a controller 34 for the dryer and a controller 35 for the discharge station.

FIG. 4 shows the installation in modular design, where a precision work station 25 includes a machine control 25 and a high-performance computer R. Precision work station 21 is a screen printing station with a feed table 47 arranged upstream and a delivery table 48 arranged downstream. A calendar 28 is arranged upstream from the feed table. FIGS. 3 and 4 show a concept with suction belt conveyance in the area of the precision work station.

FIG. 5 illustrates a preferred control scheme, where a machine control 50 coordinates and controls all the elements of the installation and supplies them with power. A bus system is labeled as 51. The part of the figure beneath the bold line for the bus system indicates the actual control system 61 for the coating operation, including the drive system for all transport elements. The drive system is composed of three drive units which communicate over serial data lines with each other and with the machine controller:

- a drive unit 52 for transport and for the counter-pressure cylinder
- a drive unit 53 for the screen printing cylinder
- a drive unit 54 for the discharge.

Drive unit 52 for the transport and for the counter-pressure cylinder drives the sheet feed, the vibrating station, the sheet conveyance by the printing machine and the counter-pressure cylinder. In the example shown here, this is a variable speed vector drive 55. This drive unit serves as a reference axis for the speed of the entire system, communicating with the screen printing unit over a serial data interface. The digital speed setpoint is preselected by machine controller M-ST over data bus 51 and sent to the screen printing unit over a serial data interface. The setpoint is sent from there to the drive unit over the above-mentioned data interface. There is an additional pulse chain link between the reference axis and the screen printing unit. The signal direction is from the reference axis to the screen printing unit. Screen printing cylinder 10 is driven with drive unit 53 for the screen printing cylinder 10. This drive unit is a variable speed servo drive 56. The drive unit references the effective system speed and position to the reference axis over the pulse chain. When operating without position correction, the speed of this drive unit corresponds exactly to that of the reference axis. In correction operation (operation with correction of position), the speed corresponds only to that of the reference axis at the intersection times. This means that the speed in the printing range of from 0 mm to 720 mm is either less than or greater than that of the reference axis. In the range from 720 to 820 mm, the speed is higher or lower than the speed of the reference axis for distance compensation. The position correction is performed by means of sinusoidal positive and negative acceleration of the screen printing cylinder. The position is evaluated on the basis of the pulse chain. A correction is calculated on the basis of the drive unit, and the machine control is not burdened with drive control, or the machine control and the bus system do not inhibit the control speed corrections.

With the drive unit for discharge conveyance, the discharge conveyance is driven by the UV dryer and sheet discharge device, for example. This is a non-variable-speed asynchronous drive 57. The drive unit receives the setpoint for the speed over a data interface from the screen printing unit. The speed is proportionally greater than the system speed.

One local controller 58 or 59 or 60 is assigned to each of three drive motors 55, 56, and 57, with direct data exchange taking place over pulse chains between local controllers 58 and 59. The two main items from the standpoint of control technology are combined as local control Module 61, where this module preferably also includes local controller 60. Instead of the pulse chain control, other servo systems, e.g., with a control over the speed input of the servo motor can also be selected for one, two or all three motors. All the control functions described here, which are directly involved in the coating, are preferably combined at the site, so that the corresponding functions are ensured locally autonomously. For example, it is possible in this way to coat a sheet using only the means of the local control system. The setpoints needed for an entire formulation are managed by the machine computer in normal operation and are transferred as setpoints to the local control module in case of need. This means that all sensors are used in the local control module in the area of the precision work station. Servo motor 56 and motor 55 are controlled by power electronics. The local controllers have the required interfaces and can also be operated directly by a keyboard 62.

FIGS. 6 and 7 show a diagram of referencing the screen cylinder and sheets. For example, a single sheet can be accelerated from a speed V1 to the precision transport speed V2 by means of a coupled motion stop 65, 65' over the path illustrated and is subsequently conveyed to the screen cylinder on constant conveyor 66 at a precise constant delivery speed V2. A photocell arrangement 67 detects the front end of each sheet on the moving conveyor. Photocells 67 are arranged at a control distance RA upstream from a theoretical screen printing line SD. Screen cylinder 10 is rotating at a speed Vx at time X (T1) when the front edge of the sheet triggers the arrival signal at photocell 85. The computer has additional sensor means and storage media so that the precise position Px or Px' of the corresponding reference points P on the screen cylinder 10 is detected at the same time. The computer R immediately begins to calculate the rotational motion and subsequently controls the rotation or the rotational speed of the screen cylinder within milliseconds in such a way that the reference point P arrives with the front edge Vk of the sheet at the theoretical screen printing line SD at the same time (or at time Z or T2), such that before the front edge Vk arrives at the reference point P, the optionally corrected rotational speed V3 is reached and either exactly matches the precision transport speed V2 or at a rotational speed that has been corrected by the amount of sheet distortion, In FIG. 6, V3' and V3" indicate the possibility that V2 is assumed to have arrived, and the rotational speed V3 may be greater or smaller by a minimal correction value. V2=V3 occurs only when the sheet does not require any correction.

FIG. 8 shows schematically a combination of a transfer station from a feed station to the coating station, where the transfer station includes gentle acceleration of the sheets. A gripper concept is indicated at the coating station. This combination may be considered to meet extremely high demands involving large, thin sheets. However, such gentle acceleration may also be a great advantage when a suction belt conveyor is used as the precision work station. In practical operation, it is not expedient to control the feed station sequence in such a way that an attempt is made with the corresponding feed to accelerate the sheets directly to the coating station. Therefore, an aligning station is provided between the feed station and the precision work station. The most important part of the, aligning station 49 is an acceleration roll 70 with clamping rolls 71 that can be pushed in and out, and with a controllable stop 72. The sheets 41 are conveyed from the feed station 43 over a conveyor belt and slip unhindered over the acceleration roll 70 at conveyance speed VA. No press marks, clamping marks or rubbing traces should be made on the sheets in the process, because they would lower the quality of the printed sheet, One particular problem is that the feed speed V1 depends on the criteria of coating and the sheets may have any desired length L. A pair of guide rolls is labeled as 73. FIG. 8 shows the basic control functions of aligning station 49, a computer C1 is connected to an incremental element JG of the downstream processing installation, where a conveyor belt 324 can be driven at speed V1 of the processing installation by drive means 74 (not shown). The acceleration roll 70 can be connected directly to a mechanical overdrive, and center line 80 can be connected directly to drives 74 on the processing end. On the other hand, the stop 72, a coupling lever 91 and mechanical coupling and uncoupling means 82 for the guide rolls 71 can be controlled by a drive unit 84 of the feed station 83 directly over the corresponding overdrive means 83 or it can be controlled from the feed station. For all three control functions, a common control shaft 85 is provided, with three cams 86, 87 and 88 being arranged on the control shaft according to the three functions. Cam 86 is in direct engagement with a grip roll 89, a lever joint 90 and a coupling lever 91 for coupling 81. Cam 87 controls the mechanical coupling and uncoupling means 82 over a lever 92 and a tie rod 93. The third cam 88 controls a rotational arm 95 of stop 72 over a lever 94.

For additional details, reference is made to the detailed description in European.Patent 586,642.

FIGS. 9 and 10 show an example of a quick change screen cylinder 10 on a larger scale. The screen cylinder 10 is driven at both ends by a common servo motor 56 which can be controlled by a local controller 59. A plurality of sensors, e.g., light sensors or photocells 67 are arranged at the side of the inlet 68. Their signals are used for referencing in local controller 59. The screen cylinder 10 can be raised and lowered in the vertical direction A—A, with flis motion also being coordinated over drive unit 53 and local module 61. The screw cylinder 10 can also be set for diagonal repeat, as indicated by the letters P and DR, and for a longitudinal repeat, as indicated by LR.

FIGS. 11 and 12 illustrate a front view and a horizontal projection of an installation, showing from right to left the installation with a feed station 43, an aligning station and the precision work station which may be designed for constant conveyance or with a chain belt or toothed belt with mechanical grippers. From the feed station to the left, this shows a feed-through installation, an acceleration station, sheet cleaning and a smoothing calendar 28.

What is claimed is:

1. A method of coating a sheet, comprising:

providing a rotatable screen cylinder;

force feeding at least one sheet to the screen cylinder;

rotating the screen cylinder;

coating the at least one sheet via the screen cylinder; and controlling the rotation of the screen cylinder based on the force feeding movement of the at least one sheet so as to promote accurate positioning of the at least one sheet relative to the screen cylinder during the coating of the at least one sheet.

2. The method of claim 1, wherein controlling the rotation of the screen cylinder comprises controlling the rotation of the screen cylinder based on a reference axis.

3. The method of claim 1, wherein controlling the rotation of the screen cylinder comprises controlling the rotation of the screen cylinder via a control unit.

4. The method of claim 1, wherein controlling the rotation of the screen cylinder comprises controlling a speed of rotation of the screen cylinder based on one of a position of the at least one sheet prior to reaching a location of the screen cylinder and a length of the at least one sheet.

5. The method of claim 1, wherein controlling the rotation of the screen cylinder comprises rotating the screen cylinder such that the speed of the rotation corresponds to a speed of a reference axis during an intersection time.

6. The method of claim 5, wherein the rotation speed of the screen cylinder is not equal to the speed of the reference axis in a printing range from 0 mm to 820 mm.

7. The method of claim 1, wherein the controlling of the rotation of the screen cylinder comprises controlling the rotation of the screen cylinder such that the speed of rotation equals a transport speed of the at least one sheet as it reaches the screen cylinder.

8. The method of claim 1, further comprising correcting a position error of the sheet by controlling the rotation of the screen cylinder so as to adjust a start coating position of the sheet.

9. The method of claim 1, wherein the controlling of the rotation of the screen cylinder comprises controlling the rotation speed of the screen cylinder based on one of a longitudinal repeat and a diagonal repeat of the at least one sheet.

10. The method of claim 9, further comprising one of accelerating and decelerating the rotation speed of the screen cylinder.

11. The method of claim 9, further comprising electronically correcting the longitudinal repeat.

12. The method of claim 1, wherein the rotating of the screen cylinder occurs via a variable speed servo motor, the variable speed servo motor being controlled via a computer.

13. The method of claim 12, further comprising monitoring a position of the sheet relative to the screen cylinder via sensors located upstream from a position of contact between the screen cylinder and the sheet.

14. The method of claim 1, further comprising feeding the sheet toward the screen cylinder in a substantially horizontal plane.

15. The method of claim 1, wherein the feeding of the sheet comprises feeding the sheet from a feeder mechanism and the method further comprises accelerating the sheet to a processing speed at a point of transfer from the feeder mechanism.

16. The method of claim 15, wherein a stack of sheets are disposed in the feeder mechanism and the method further comprises shedding each sheet from the stack on a suction belt table, sending each sheet to the transfer point via mechanical grippers, and accelerating each sheet to the processing speed.

17. The method of claim 1, further comprising one of drying, curing, and stabilizing the at least one sheet after coating the sheet.

18. A method of using the device of claim 1, the method comprising:

at least one of ink printing, lacquering, and applying special coating material to at least one sheet via the at least one screen cylinder.

19. A device for coating a sheet, comprising:

at least one screen cylinder positioned downstream of a sheet feeding mechanism, the screen cylinder being configured to coat a sheet;

a constant speed conveyor for feeding a sheet from the feeding mechanism to the screen cylinder; and a variable speed drive for rotating the screen cylinder, wherein the variable speed drive is configured to rotate the screen cylinder based on one of a print length and a print position of the sheet to be coated.

20. The device of claim 19, further comprising at least one counter-pressure cylinder disposed substantially opposite to the at least one screen cylinder.

21. The device of claim 20, wherein the variable speed drive comprises a variable speed servo drive and the device further comprises a variable speed vector drive configured to drive the counter-pressure cylinder.

22. The device of claim 21, further comprising a first local control unit for controlling the variable speed servo drive and a second local control unit for controlling the variable speed vector drive.

23. The device of claim 22, further comprising a machine controller for controlling working speeds of the device and a local controller for controlling the local control units so as to perform corrective controls.

24. The device of claim 21, further comprising a sheet transport mechanism for transporting a sheet to be coated at least from the sheet feed mechanism to the screen cylinder, wherein the variable speed vector drive is configured to drive the sheet transport mechanism.

25. The device of claim 19, wherein the at least one screen cylinder comprises a quick change rotary screen printing cylinder for screen printing.

26. The device of claim 19, further comprising a drive mechanism associated with the sheet feeding mechanism.

27. The device of claim 26, wherein the drive mechanism associated with the sheet feeding mechanism and the variable speed drive are configured to be synchronized.

28. The device of claim 19, wherein the screen cylinder is configured to be movably adjustable in one of an angular direction and a direction of motion of the feeding of the sheet.

29. The device of claim 19, further comprising a suction belt conveyor disposed between the sheet feeding mechanism and the screen cylinder.

30. The device of claim 29, further comprising a sheet acceleration mechanism.

31. The device of claim 30, wherein the sheet acceleration mechanism comprises one of a continuous chain conveyor and a toothed belt conveyor.

32. The device of claim 29, wherein a working plane forms a common plane with belts of the suction belt conveyor.

33. The device of claim 19, further comprising a plurality of stations for various types of coating of the sheets.

34. The device of claim 33, wherein the various types of coating are chosen from screen printing, lacquering, coating for effect, and printing with special inks.

35. The device of claim 19, further comprising a plurality of screen cylinders.

36. The device of claim 35, wherein each of the plurality of screen cylinders is located in a different work stations and at least two of the screen cylinders are configured for differing types of coating processes.

37. The device of claim 36, wherein the differing types of screen printing are chosen from ink printing, lacquering, and applying special coating material.

38. A device for coating a sheet, the device comprising:

means for force feeding at least one sheet to a screen cylinder for coating the at least one sheet via the screen cylinder;

means for rotating the screen cylinder; and means for controlling the rotation of the screen cylinder based on a least one of a print length and a print position of the at least-one sheet.

* * * * *